United States Patent [19]

Marinelli

[11] Patent Number: 4,533,567

[45] Date of Patent: Aug. 6, 1985

[54] CARBONLESS PAPER COATING FORMULATION

[75] Inventor: Nicola Marinelli, Dayton, Ohio

[73] Assignee: NCR Corporation, Dayton, Ohio

[21] Appl. No.: 497,773

[22] Filed: May 24, 1983

[51] Int. Cl.[3] ..... B41M 5/22

[52] U.S. Cl. ..... 427/150; 346/214; 346/226; 427/151; 427/152

[58] Field of Search ..... 282/27.5; 428/320.4–320.8, 411, 488, 537, 913, 914; 346/214, 226, 215, 216, 225; 427/150–152

[56] References Cited

U.S. PATENT DOCUMENTS

| | | | |
|---|---|---|---|
| 3,421,894 | 1/1969 | Baum | 346/214 |
| 3,554,781 | 1/1971 | Matsukawa | 346/215 |
| 4,171,981 | 10/1979 | Austin et al. | 282/27.5 X |
| 4,347,283 | 8/1982 | Hiraishi et al. | 346/214 |
| 4,411,451 | 10/1983 | Matsushita et al. | 282/27.5 |
| 4,435,471 | 3/1984 | Matsushita et al. | 346/214 |

*Primary Examiner*—Bruce H. Hess

*Attorney, Agent, or Firm*—Wilbert Hawk, Jr.; George J. Muckenthaler

[57] ABSTRACT

A carbonless CFB paper includes an aqueous wax emulsion added to the CB coating to act as a barrier between the reactants in the CB coating and in the CF coating, thereby preventing precolor caused by reactants seeping into or penetrating the base paper and reacting with any ruptured capsules in the CB coating.

5 Claims, 3 Drawing Figures

X X X X CF COATING

○ ○ ○ ○ CB COATING (CAPSULAR)

▭ ▭ ▭ ▭ ▭ WAX EMULSION

PAPER

CARBONLESS PAPER COATING FORMULATION

BACKGROUND OF THE INVENTION

In the field of thermal printing and the use of heat-sensitive, coated paper or like record material in the printing operation, the presence of the dye solution in the coating formulation or the formulation of the substrate itself has resulted in certain precoloring conditions which affect the quality of print and usefulness of the paper. As is well-known in the impact printing art, the carbonless paper, useful for transferring ink material to one or more additional sheets, is generally coated with microscopic capsules containing at least one of the reactive ingredients which produce the mark that is initiated by an impact element against the paper and which impact element causes eruption of the capsules and release of the ink material dye.

In a typical and well-known arrangement, a top or first sheet of a manifold of sheets may include a coating on the back surface thereof and such sheet is referred to as a "CB" sheet, one or more intermediate sheets may include a coating on the front surface and a coating on the back surface and which are termed "CFB" sheets, and the bottom or last sheet has a coating on the front surface and is referred to as a "CF" sheet. The direct impact on the top or CB sheet causes a mark thereon to be transferred by rupturing the capsules on the back thereof, the CFB sheet causes formation of the mark by reaction with the coating on the front and transfer of such mark through rupture of the capsules on the back of the intermediate sheet, and the CF sheet is marked by reaction with the coating on the front thereof in a manner to provide the mark on all sheets.

It has been found that during handling of a stack of CFB sheets or a roll of CFB paper having the capsular formulation, a front coating of one sheet or layer of the roll may be in contact with a back coating of an adjacent sheet or layer and such handling or perhaps rough treatment of the stack or roll of paper may cause inadvertent rupture of the capsules in the back coating, allow the dye to transfer to the adjacent sheet or layer or to mix with other reactants, and thereby precolor the paper. Additionally, a CFB sheet having a CF coating on the front surface and a CB capsular coating on the back surface may be subject to precoloring due to inadvertent contact of the reactant particles or coating material.

Representative documentation in the field of carbonless paper relative to the present invention includes U.S. Pat. No. 3,421,894, issued to H. H. Baum on Jan. 14, 1969, which discloses a paper-like sheet having a layer of heat-meltable wax with chromogenic material particles disposed therein. The layer of wax is heated to its melting point, subjected to ultraviolet light to form an image, and then reheated to a temperature where the image turns blue to fix the image.

U.S. Pat. No. 3,445,261, issued to S. G. Talvalkar on May 20, 1969, discloses heat-sensitive record material comprising a paper base sheet, a coating of acidic particles and colorless chromogenic particles, and a protective film of polyvinyl alcohol having dispersed therein to the extent of about 2% fine particles of a lubricating or powdered nontacky wax in the coating.

U.S. Pat. No. 3,674,535, issued to J. H. Blose et al. on July 4, 1972, discloses heatsensitive record material comprising a paper base sheet and a coating of colorless chromogenic material and a bisphenol distributed in a polyvinyl alcohol in combination with a filler such as clay, a lubricant such as zinc stearate and a powdered nontacky wax.

U.S. Pat. No. 4,062,567, issued to N. Macaulay on Dec. 13, 1977, discloses dual system carbonless paper in a manifolded set comprising at least two different types or systems of intermediate sheets, one sheet of which has a front coating capable of reacting with the back coating of the other sheet to produce a color. The manifolded set has one CFB sheet with front and back coatings wherein the reactive material in the back coating of each intermediate sheet is incapable of reacting with the material in the front coating of the same sheet and such CFB sheets may be stacked without danger of inadvertent coloration during handling and storage.

U.S. Pat. No. 4,197,346, issued to M. F. Stevens on Apr. 8, 1980, discloses a self-contained pressure-sensitive record material having a substrate and a coating of a mixture of pressure-rupturable capsules of an oily solvent solution of colorless chromogenic material and capsules of solid acidic resin particles. The acidic resin reacts with the chromogenic material to produce a color and has less print bleed than known self-contained systems.

U.S. Pat. No. 4,321,093, issued to M. E. Seitz on Mar. 23, 1982, discloses a color developer ink for use in producing a CF coating applied by a printing press and wherein an oil or wax may be added as a replacement for a portion of the solvent to alleviate the printing problem with loose paper fibers.

And, U.S. Pat. No. 4,343,494, issued to G. H. Ehrhardt et al. on Aug. 10, 1982, discloses a pressure sensitive, carbonless copy, paper system having a wax base hot-melt type coating for one surface containing a zinc chloride or like metallic salt and acidic halogen neutralizing agent solution, and an image receptor coating for the other surface employing phenyl methenol as a dye precursor-type chromogenic reagent material.

SUMMARY OF THE INVENTION

The present invention relates to carbonless paper for use in multiple-copy printing operations. More particularly, the invention is directed to the capsular coating on the back surface of a CFB record sheet or like substrate and to the formulation of the coating material thereon. A wax emulsion is added and incorporated into the capsule emulsion as an ingredient of the coating which is applied on the back of the record sheet, the wax in such capsule emulsion being in a state that provides for effecting a barrier between the back coating and the coating on the front of the sheet. The method provides for using a carbonless CB paper that can withstand an on-press CF coating operation to produce a carbonless CFB paper with minimal or no susceptibility to precoloring of the paper. The procedure includes the step of replacing a predetermined quantity of the CB capsules and solid material with an equal amount of aqueous wax emulsion to provide a barrier-type coating between the reactants.

In a preferred arrangement of the invention, the record sheet of paper or the like is coated with a capsular-wax coating on the back side thereof to produce the CB paper. The capsular-wax coating essentially consists of an aqueous capsule emulsion, a wax emulsion, a soluble starch and a particulate or non-soluble starch. The CB paper is then processed in well-known manner through a printing press operation to apply the CF coating containing phenolic resin on the front side of the paper to produce the carbonless CFB paper. It is during this CF coating operation that the CB aqueous wax emulsion in the form of a protective layer or film prevents or at least minimizes contact of the reactive materials and thereby substantially eliminates any precolor in the finished CFB record sheet.

In accordance with the above discussion, the principal object of the present invention is to provide an improved coating formulation for carbonless paper or like record material.

Another object of the present invention is to provide a method for preventing or at least minimizing the precoloring in carbonless paper.

An additional object of the present invention is to provide a wax barrier coating between the reactants of a carbonless paper system.

A further object of the present invention is to provide a wax emulsion as an ingredient in the coating material to prevent penetration of dye solution into the record material base.

Additional advantages and features of the present invention will become apparent and fully understood from a reading of the following description taken together with the annexed drawing.

DESCRIPTION OF THE PREFERRED EMBODIMENT

Figure 1:
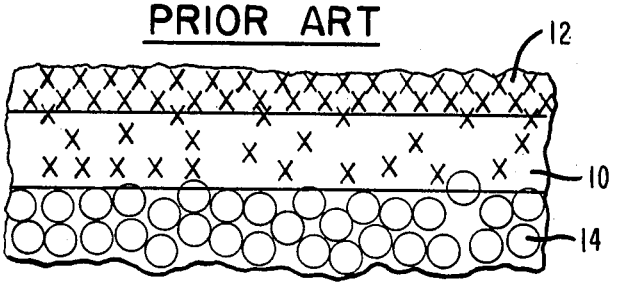
FIG. 1 PRIOR ART
FIG. 1 is a diagrammatic view of a conventional coated, carbonless record sheet.

FIG. 1 shows a conventional construction of carbonless record media wherein a substrate 10 of paper or like material has a phenolic resin coating 12 on the front side thereof and a capsular coating 14 on the back side. The resin CF coating 12 and the capsular CB coating 14 on the paper 10 form a CFB sheet. As mentioned above, handling and/or storage of a stack of CFB sheets or roll of CFB paper can and sometimes does result in a mixing of the reactant materials wherein the CF coating seeps into or penetrates the body of the paper and certain particles of the CF coating may contact capsules of the CB coating, which CB capsules have become inadvertently ruptured and thereby cause precolor of the paper. The CB coating capsules contain a color former or dye ingredient which is released upon rupture of any of the capsules and contact of the dye with particles of the CF coating causes the precolor condition. The two coatings react with each other to form a blue color in the paper 10 which is premature in the use of the paper and such blue color may be significant so as to prevent normal use of the paper. While a certain amount of capsule rupture is caused by handling and/or storage of the paper in stacks or rolls with resulting precolor, additional precolor can and does result from the printing press operation or like application of the CF coating on the paper. In this respect the oil used in the CF formulation is a non-volatile solvent or like vehicle that moves into or penetrates the paper and may cause precolor thereof.

In the attempts to produce a satisfactory carbonless CFB paper, a printing press has been employed to apply the CF coating of phenolic resin material on the front of the paper which previously had been coated on the back side with the capsular CB coating. While there are numerous formulations used for the carbonless CB paper, two of the well-known stock materials include a CB paper as manufactured by Appleton Papers, Inc., of Appleton, Wis., and a CB paper as manufactured by The Mead Corporation, of Dayton, Ohio. The printing press has been used to apply spot or full sheet CF coating on the CB paper, however, the blue precolor may be evident in the finished CFB product and, as such, the paper is not satisfactory for commercial use.

Figure 2:
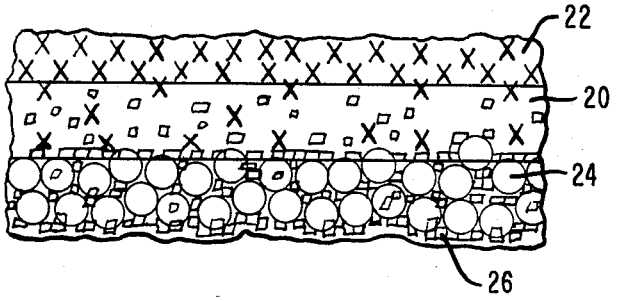
FIG. 2 is a diagrammatic view of a coated carbonless record sheet incorporating the subject matter of the present invention.

The present invention is directed to preventing or at least minimizing the chances of premature mixing of the reactive coatings and the resultant precolor condition by providing a barrier between the coatings on either side of the paper. Such precolor condition is unwanted and undesirable and greatly lessens the quality and usefulness of the carbonless paper. FIG. 2 illustrates the arrangement of the present invention wherein a substrate 20 of paper or like material has a coating 22 on the front or top thereof and a capsular coating 24 on the back or bottom of the paper. The CF coating 22 and the CB coating 24 on the paper 20 form a CFB sheet. In accordance with the present invention, another coating or emulsion 26 is mixed into or formulated with the CB coating 24 in manner and arrangement wherein the coating 22 and the coating 24 are protected and maintained in separate form or condition by the emulsion 26 acting as a barrier between the particles or ingredients of the two coatings 22 and 24.

The preferred method of producing a carbonless CFB paper which is substantially immune to the blue precolor includes the step of incorporating wax, in the form of an aqueous wax emulsion, as an ingredient in the CB capsule coating 24 to act as a barrier, in the nature of a layer or film, between any CB dye or color former and phenolic resin or color developer material of the CF coating which may enter or penetrate the paper 20. The wax emulsion 26 contains particles of wax which, in effect, replace at least a portion of the capsules in the CB coating 24. Through the use of such emulsion, the reduced CB capsular content provides good image transfer by being compensated with improved transfer efficiency of dye solution from the CB capsules to an adjacent CF coating due to the wax acting as a barrier against such dye solution entering or penetrating the supporting paper stock 20 after rupture of any of the CB capsules. FIG. 2 therefore illustrates a CFB paper having the aqueous wax emulsion coating 26 intermixed in the CB coating 24 to eliminate or at least minimize any blue precoloring of the paper 20.

Figure 3:
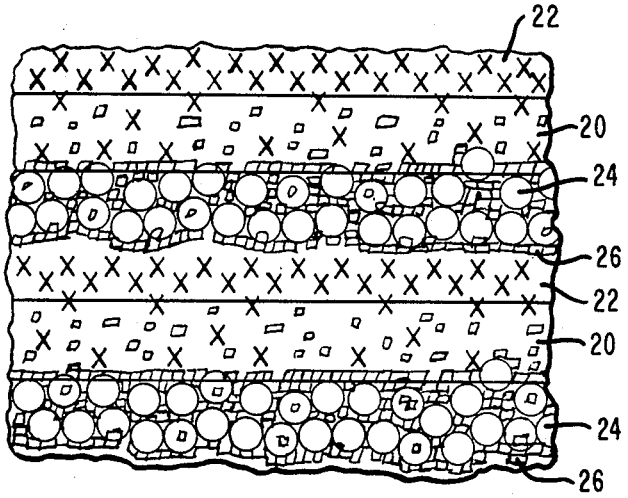
FIG. 3 is a diagrammatic view of a plurality of coated carbonless record sheets incorporating the subject matter of the present invention.

FIG. 3 illustrates the arrangement of multiple sheets of CFB paper with the CF coating 22 on the one side and the CB coating 24 on the other side of the paper stock 20. The wax emulsion 26 provides a wax filler to protect the CB side of one CFB sheet from reacting with the CF side of a second CFB sheet. The addition of the wax emulsion 26 to the capsular coating 24 particularly lends protection from precolor conditions where either solvent CF or press-type CF coatings have been used to produce CFB paper. The addition of such wax emulsion 26 would also lend protection from precolor to the standard aqueous dispersion CF of standard CFB paper, as illustrated in FIG. 1.

It is thus seen that the wax emulsion 26 incorporated into the CB coating 24 of CFB paper provides or gives the effect of a barrier coating between the CF and CB reactants and that the wax emulsion particles substantially envelop the CB capsules. The procedure includes the step of replacing a predetermined quantity of CB capsular solids with wax solids or particles which are added as an aqueous wax emulsion to the capsular formulation on a one-to-one basis. The optimum quantity of wax substitution for CB capsules is determined by the properties of the CB paper produced in meeting pertinent test specifications including print intensity, smudge, or other parameters of current commercial carbonless papers. While the wax particles are illustrated as individual particles in the capsule wax emulsion 26, it is probable that such individual particles coalesce into a continuous film upon drying. Since the wax particles are appreciably smaller (approximately one micron in diameter) than the capsules of the CB coating 24, it is predictable that such wax particles settle and concentrate at or near the paper 20 interface to form a continuous layer and barrier between the CB capsules and the CF material.

It is further seen that the incorporation of the aqueous wax solution 26 into the CB capsular coating 24 acts as a holding agent for the color former or dye solution contained in the CB capsules after rupture of the activated capsules, thereby keeping the dye solution from penetrating the paper stock 20 and, in turn, promoting dye transfer efficiency to adjacent CF paper. It has therefore been found that adding the prescribed amount of wax into the capsular coating 24 does not limit or detract from print quality.

Still further, it is seen that incorporation of the wax emulsion 26 into the CB coating 24 may effect a cost-savings by reason that the quantity of wax replaces an equal quantity of capsular solid material. The amount of savings, of course, depends on the relative costs of the wax and the CB capsular emulsion.

The waxes which have been incorporated into the CB coating 24 have included Jonwax 120, a wax emulsion of polyethylene and paraffin wax; Jonwax 26, a wax emulsion of polyethylene wax; and Jonwax 22, described as a water-base wax compound. Jonwax is a trademark of S. C. Johnson & Son, Inc., of Racine, Wis.

EXAMPLE I

Example I is a CB coating formulation containing 36% wax solids in the dry coating and applied on the back surface of a paper substrate having a CF coating formulation available from Appleton Papers, Inc.

CB COATING FORMULATION

| Material | Percent Dry Weight |
|---|---|
| Capsule Batch (54.1% solids) | 35.8 |
| Jonwax 120 (35% solids) | 36.0 |
| Stayco S Starch (10% soluble) | 6.1 |
| Keystar 328 Starch (88% solids) | 22.1 |

EXAMPLE II

Example II is a CB coating formulation containing 22% wax solids in the dry coating and applied on the back surface of a paper substrate having a CF coating formulation available from Appleton Papers, Inc.

CB COATING FORMULATION

| Material | Percent Dry Weight |
|---|---|
| Capsule Batch (54.0% solids) | 49.8 |
| Jonwax 120 (35% solids) | 22.0 |
| Stayco S Starch (10% soluble) | 6.1 |
| Keystar 328 Starch (88% solids) | 22.1 |

The procedure for formulating the CB capsular coating includes the steps of combining, by gentle agitation, the Stayco S soluble starch solution, the capsule emulsion and the Jonwax 120 emulsion. The Keystar 328 non-soluble starch is then added to the above combination by stirring at moderate speed to uniformly disperse the particulate starch throughout the formulation. Stayco S Starch is available from A. E. Staley Manufacturing Company, of Decatur, Ill. 62525, and Keystar 328 Starch is available from Henkel Corporation, of Minneapolis, Minn. 55435. The capsule batch (54% solids) is prepared in the laboratory in accordance with procedures provided by Appleton Papers, Inc.

The CF coating formulation to be applied to the front surface of the paper substrate by use of the printing press is as follows:

CF COATING FORMULATION

| Material | Percent Dry Weight |
|---|---|
| Phenolic resin | 28 |
| Magie ink oil 535 | 29 |
| Petrolatum | 11 |
| Kaolin clay | 30 |
| Fluorescent dye | 2 |

The CF coating is prepared by mixing the phenolic resin and the ink oil at a temperature of 150° F. When a sample of this mixture shows a complete solution of the resin by visual inspection of the solution in a test tube, the kaolin clay (pigment) is added with vigorous agitation until further dispersion produces no further dispersing effect (approximately 10–15 minutes after last addition). The petrolatum is then added to the solution and mixed until such petrolatum is fully dispersed (approximately 10–15 minutes). The mixture is then run over a three-roll mill to reduce all particulates to less than 25 microns. The final mixture is agitated with a mixer to obtain a uniform product.

It is noted that the formulation of the ink coating is based on the use of a phenolic resin as the resin portion of a colorless ink and simultaneously as the color reactive portion of the coating formulation. The ink oil provides a solvent for the resin and a vehicle for the ink, and the amount of the ink oil controls the tack and flow characteristics of the ink. The petrolatum is used to adjust the body and the length of the ink, while the clay is provided as a filler and a pigment for the ink.

The phenolic resin is available from Durez Division, Hooker Chemical and Plastic Corporation, of North Tonawanda, N.Y. The Magie ink oil 535 is available from Magie Brothers Oil Company, Division of Pennzoil, Franklin Park, Ill., and the petrolatum is available from Witco Chemical Company, Inc., New York, N.Y. 10017. Further, the kaolin clay is available from Georgia Kaolin Company, Elizabeth, N.J., 07207, and the fluorescent dye is available from HiltonDavis Company, Cincinnati, Ohio.

EXAMPLE III

Example III is a CFB coating formulation containing 36% wax solids in the dry coating and applied on the back surface of a paper substrate and including the CF coating formulation as applied by the printing press on the front surface.

| CB COATING FORMULATION | |
|---|---|
| Material | Percent Dry Weight |
| Capsule Batch (54.1% solids) | 35.8 |
| Jonwax 120 (35% solids) | 36.0 |
| Stayco S Starch (10% soluble) | 6.1 |
| Keystar 328 Starch (88% solids) | 22.1 |

| CF COATING FORMULATION | |
|---|---|
| Material | Percent Dry Weight |
| Phenolic resin | 28 |
| Magie ink oil 535 | 29 |
| Petrolatum | 11 |
| Kaolin clay | 30 |
| Fluorescent dye | 2 |

EXAMPLE IV

Example IV is a CFB coating formulation containing 22% wax solids in the dry coating and applied on the back surface of a paper substrate and including the CF coating formulation as applied by the printing press on the front surface.

| CB COATING FORMULATION | |
|---|---|
| Material | Percent Dry Weight |
| Capsule Batch (54.0% solids) | 49.8 |
| Jonwax 120 (35% solids) | 22.0 |
| Stayco S Starch (10% soluble) | 6.1 |
| Keystar 328 Starch (88% solids) | 22.1 |

| CF COATING FORMULATION | |
|---|---|
| Material | Percent Dry Weight |
| Phenolic resin | 28 |
| Magie ink oil 535 | 29 |
| Petrolatum | 11 |
| Kaolin clay | 30 |
| Fluorescent dye | 2 |

It is seen that the dye solution or color former in the CB, encapsulated particle, coating formulation is a soluble type dye which reacts and is compatible with the phenolic resin or color developer in the CF coating formulation to form an image or mark.

Each of the above CB coatings is sufficient to withstand the force or pressure of applying the associated CF coating on the paper substrate by means of the printing press to produce a carbonless CFB paper that develops minimal or no evidence of precolor in the finished product. It has been found that the amount of wax solids in the wax emulsion can range from 10% to 50% of the capsular coating, the lower percentage giving less precolor protection and better printing, and the higher percentage giving better precolor protection and lower print quality. It should be noted that the capsule batch portion of the CB coating formulation is in accordance with a formula provided by Appleton Papers, Inc.

It is thus seen that herein shown and described is a carbonless paper coating that includes an aqueous wax emulsion intermixed with capsular particles for providing a protective film between reactants of one CFB sheet or between adjacent CFB sheets of paper to prevent or at least minimize precolor of the paper. The present invention enables the accomplishment of the objects and advantages mentioned above, and while a preferred embodiment of the invention has been disclosed herein, variations thereof may occur to those skilled in the art. It is contemplated that all such variations and modifications not departing from the spirit and scope of the invention hereof are to be construed in accordance with the following claims.

I claim:

1. A method of making pressuresensitive record media with a substrate having front and back surfaces, comprising the steps of providing a color-forming coating material in encapsulated form for the back surface, mixing an aqueous emulsion of wax with the back surface coating material, the aqueous emulsion containing a wax selected from the group having a polyethylene base, coating the substrate on the back surface with the mixture of encapsulated material and wax emulsion in a manner wherein the wax emulsion substantially envelops the encapsulated material, and coating the substrate on the front surface with a material having color-developing phenolic resin as an ingredient thereof whereby the phenolic resin reacts with the color-forming coating material to form an image upon rupture of the encapsulated material.

2. The method of claim 1 wherein the wax emulsion contains a wax selected from the group having a polyethylene and paraffin base.

3. The method of claim 1 wherein the wax emulsion contains a wax selected from the group having a water base wax compound.

4. The method of claim 1 wherein the capsular emulsion contains a soluble wax having from 20% to 25% wax solids in the dry weight condition.

5. The method of claim 1, wherein the capsular emulsion contains a soluble wax having from 35% to 40% wax solids in the dry weight condition.

* * * * *